US005093767A

United States Patent [19]

Burn

[11] Patent Number: 5,093,767

[45] Date of Patent: Mar. 3, 1992

[54] SPACE LIGHTING FITTING

[75] Inventor: Michael Burn, Suffolk, England

[73] Assignee: Light Years Ahead Limited, Ipswich, England

[21] Appl. No.: 555,584

[22] Filed: Jul. 19, 1990

[30] Foreign Application Priority Data

Jul. 26, 1989 [GB] United Kingdom ..... 8917055

[51] Int. Cl.[5] ..... F21S 3/02

[52] U.S. Cl. ..... 362/217; 362/125; 362/269; 362/371; 362/220

[58] Field of Search ..... 362/125, 371, 277, 282, 362/269, 217, 220

[56] References Cited

U.S. PATENT DOCUMENTS

| | | | |
|---|---|---|---|
| 2,362,148 | 11/1944 | Naysmith | 362/220 |
| 3,609,337 | 9/1971 | La Canada et al. . | |
| 3,885,150 | 5/1975 | Ott | 240/174 |
| 4,164,784 | 8/1979 | Jaksich | 362/282 |
| 4,403,278 | 9/1983 | Flood | 362/371 |
| 4,535,393 | 8/1985 | Aspenwall | 362/125 |
| 4,779,178 | 10/1988 | Spitz | 362/269 |

FOREIGN PATENT DOCUMENTS

| | | |
|---|---|---|
| 307758 | 3/1989 | European Pat. Off. . |
| 315520 | 5/1989 | European Pat. Off. . |
| 1014620 | 8/1952 | France . |
| 8505433 | 12/1985 | World Int. Prop. O. . |

*Primary Examiner*—Ira S. Lazarus
*Assistant Examiner*—Sue Hagarman
*Attorney, Agent, or Firm*—Charles E. Baxley

[57] ABSTRACT

There is disclosed a space lighting fitting for strip lighting such as fluorescent tubes comprising an extrusion comprising an open, reflector portion which houses lamp holder means for holding a lamp therein and a containment portion housing electrical components associated with the electricity supply to the lamp holder means.

20 Claims, 4 Drawing Sheets

SPACE LIGHTING FITTING

BACKGROUND TO THE INVENTION

This invention relates to space lighting fittings for strip lighting particularly, but not exclusively, for fluorescent tubes.

Conventional fluorescent tube fittings are made of folded sheet material and have various arrangements for mounting to ceilings, or other fixed structures Very often, concealed fittings are used, especially with suspended ceilings, in which the tube, or more usually a bank of tubes, is concealed in a recess in the suspended ceiling and covered with a diffuser. The sheet metal fitting is usually enamelled white, though occasionally silvered reflectors are found, and collimators, which is to say grid-like arrangements of reflective strips disposed in front of the tubes, which allow direct-from-the tube light to spread only over a limited extent more or less directly below, for example, a recessed ceiling fitting, are used instead of translucent plastic sheet diffusers.

These conventional arrangements have a number of disadvantages which, however, on account of the many advantages of fluorescent lighting, generally have been tolerated and perhaps even been largely unobserved Nevertheless, there is considerable scope for improvement.

The present invention provides space lighting fittings which are considerably improved over conventional fittings and which do not have the disadvantages referred to, among which may be noted a complicated and expensive construction, inefficient use of energy, difficulties in installation and in removal for replacement and repair, generally static and inflexible disposition and hence functional but featureless and uninteresting architectural possibilities.

SUMMARY OF THE INVENTION

The invention comprises a space lighting fitting for strip lighting such as fluorescent tubes comprising an extrusion comprising an open, reflector portion which houses lamp holder means for holding a lamp therein, and a containment portion housing electrical components associated with the electricity supply to the lamp holder means.

The fitting may comprise an aluminium extrusion.

The containment portion may comprise a radio frequency screen for suppression of interference by the equipment associated with the fluorescent tube. The containment portion may be closed in cross section.

The reflector portion may be of elliptical or parabolic cross section The precise shape may well depend upon whether it houses one tube or more than one and upon the spread of light required, but a parabolic or elliptical reflector with a simple tube at the or a focus thereof will cast a very uniform spread of light over a useful area.

The containment portion may serve as a support for the fitting and may house pivotal support means for the fitting. Such pivotal support means may comprise an insert which fits snugly inside the containment portion and has journal bearing means for a mounting bracket. Such mounting bracket may be a two part bracket which may clamp over the journal bearing means whereby the fitting can be adjusted pivotally and retained frictionally in a set angular position - the clamp arrangement can be factory pre-set and adjusted to give the right degree of freedom of movement of the two parts being held together by adjustable screw means.

The mounting bracket may house electrical connector means which may be fused.

The mounting bracket may cooperate in quick release fashion with a fixed structure bracket part, which may also comprise electrical connector means.

Spacing support means, which may comprise tubular support means, may space the extrusion from the fixed structure.

Said tubular support means may include a rigidifying tension wire, acting after the fashion of a magicians "foldable" wand.

The fitting may comprise an insert having a reflective surface for the reflector portion. Said insert may be of a flexible sheet material such as a silvered plastics material, whereby to be adapted to the cross section of the reflector portion.

The fitting may have end caps closing off the ends of the extrusion and housing the lamp holder means.

A lensed refractor may close the reflector portion of the fitting and participate in ensuring an even spread of light over a desired angle, without substantially absorbing or wastefully scattering light.

The invention will be further apparent from the following description and several figures of the accompanying drawings, which illustrate, by way of example only, embodiments of space lighting fitting according to the invention.

DETAILED DISCLOSURE OF THE PREFERRED EMBODIMENT

Figure 1:
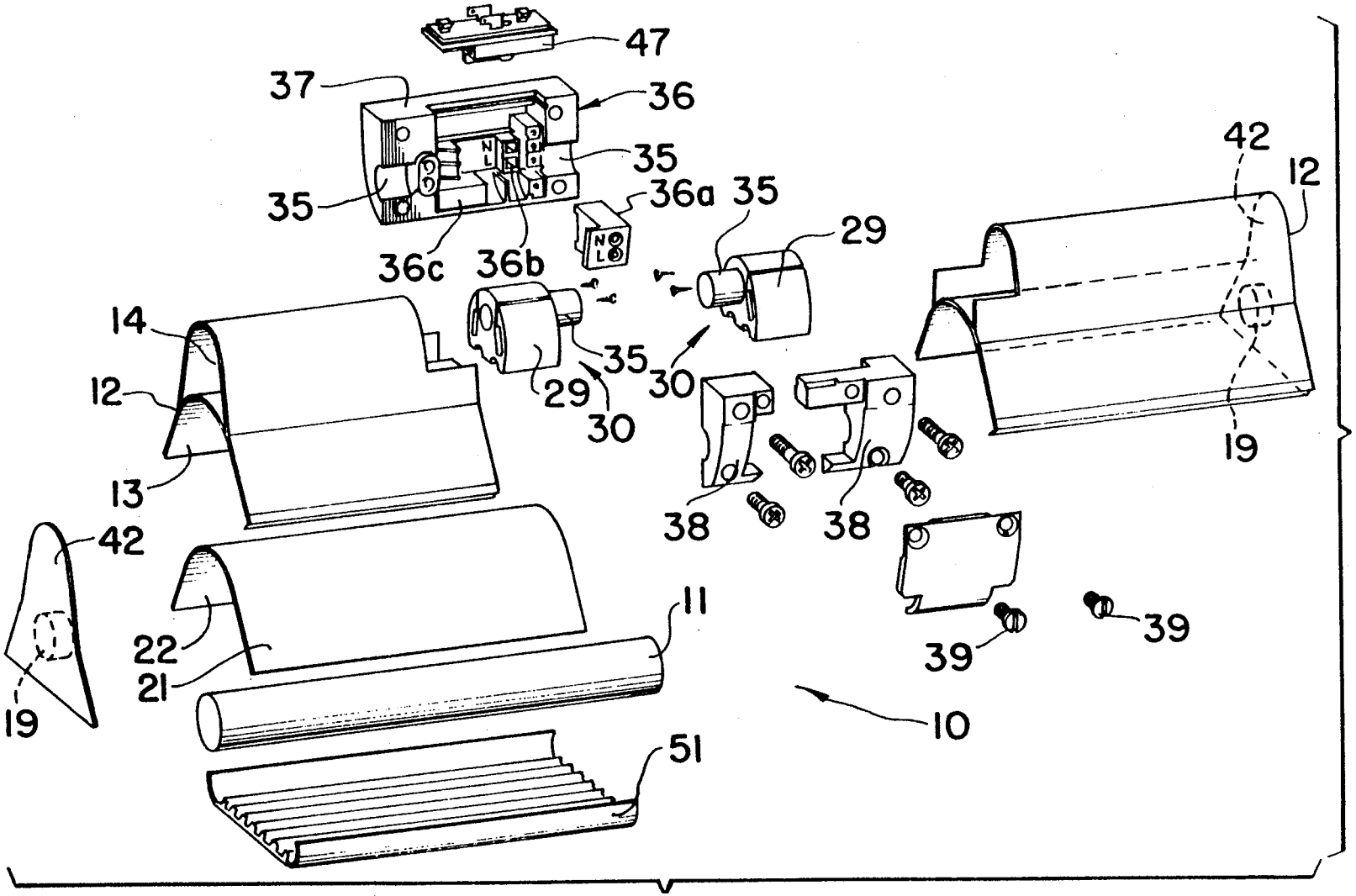
FIG. 1 shows an expanded perspective view of a first form of lighting fitting according to the invention.

FIG. 1 shows a space lighting fitting 10 for strip lighting such as fluorescent tubes 11 comprising an aluminium extrusion 12 comprising an open, reflector portion 13 which houses tube holder means 19 for holding the tube 11 therein and a containment portion 14 housing electrical components generally shown at 15 associated with the electricity supply to the tube holder means 19.

The containment portion 14, by virtue of being closed in cross section, forms a radio frequency screen for suppression of interference by the equipment associated with the fluorescent tube 11, which can be contained completely inside it.

The reflector portion 13 of the fitting 10 as shown is of parabolic cross section, although it will be appreciated that it might equally be, for example, of elliptical cross section. The precise shape may well depend upon whether the fitting 10 houses one tube 11 or more than one (only one is illustrated) and upon the spread of light required, but a parabolic or elliptical reflector with a single tube 11 at the or a focus thereof, will cast a very uniform spread of light over a useful area.

A lensed refractor 51, whose cross section consists of a plurality of plano-convex lens forms, and which may be fabricated from translucent or transparent plastics, closes the reflector portion 13 of the fitting 10.

The fitting 10 comprises an insert 21 having a reflective surface 22 for the reflector portion 13. Said insert 21 is of flexible sheet material such as a silvered plastics material, which can be bent to the cross section of the reflector portion 13.

The fitting 10 has end caps 42 closing off the ends of the extrusion 12 and housing the lamp holder means 19.

The containment portion 14 of the extrusion 12 serves as a support for the fitting 10 and houses a pivotal support 30 for the fitting 10. Such a pivotal support 30 comprises an insert 29 which fits snugly inside the containment portion 14 of the extrusion 12 and has a journal bearing 35 for engaging a mounting bracket 36.

The mounting bracket 36 comprises two parts 37,38 which clamp over the journal bearing 35 of the insert 29 whereby the fitting 10 can be adjusted pivotally and retained frictionally in a set angular position. This clamp arrangement can be factory pre-set and adjusted to give the right degree of freedom of movement of the two parts 37,38 being held together by adjustable screws 39.

The bracket 36 houses electrical connectors for external and internal wiring and incorporates a plug **36*a* and socket 36*b* arrangement by which the starter of a fluorescent tube, which can be concealed inside the containment portion 14, can be connected and disconnected without interfering with wired connections There is a fuse holder at 36*c***.

Figure 2:
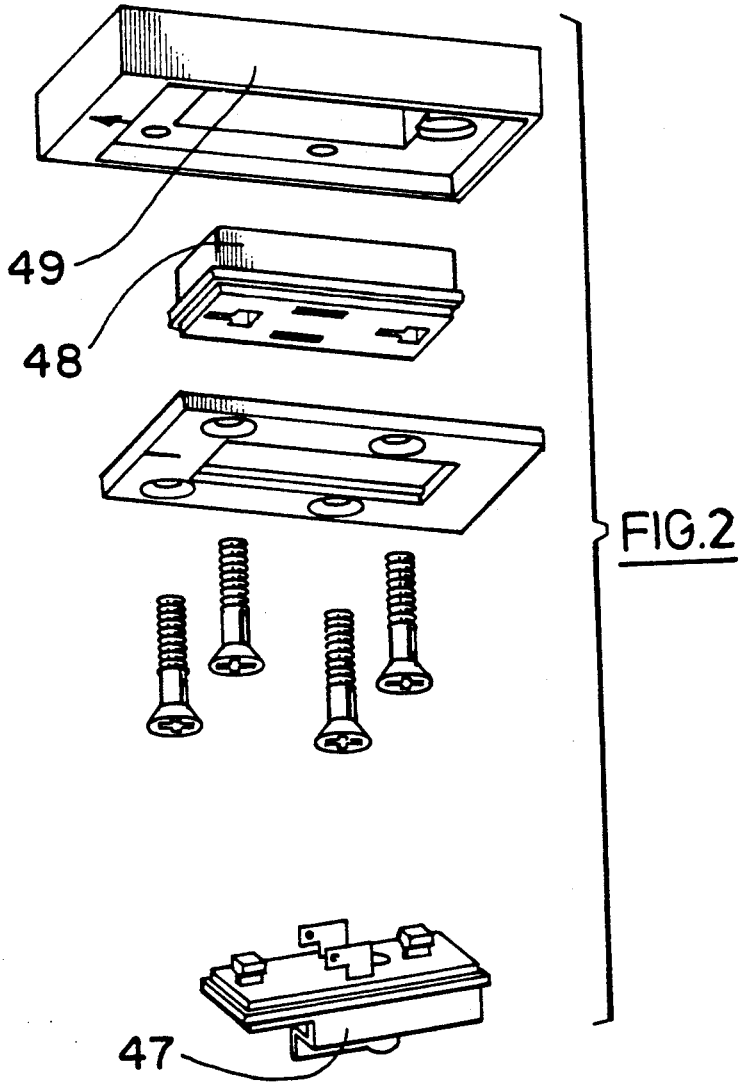
FIG. 2 shows an expanded perspective view of a first form of mounting bracket through which the fitting of FIG. 1 is attached, in quick release fashion, to a fixed structure.

The mounting bracket 36 cooperates in quick release fashion with a fixed structure part shown in FIG. 2 at 49. This can be achieved as shown in FIG. 2, by the mounting bracket 36 engaging at a Klik plug 47 and which mates with a Klik socket 48 comprised within the fixed structure 49. Such a plug and socket arrangement permits of the plug pins being inserted into their sockets and then moved laterally to click into connecting engagement with no risk of being released except by deliberate removal action.

Figure 3:
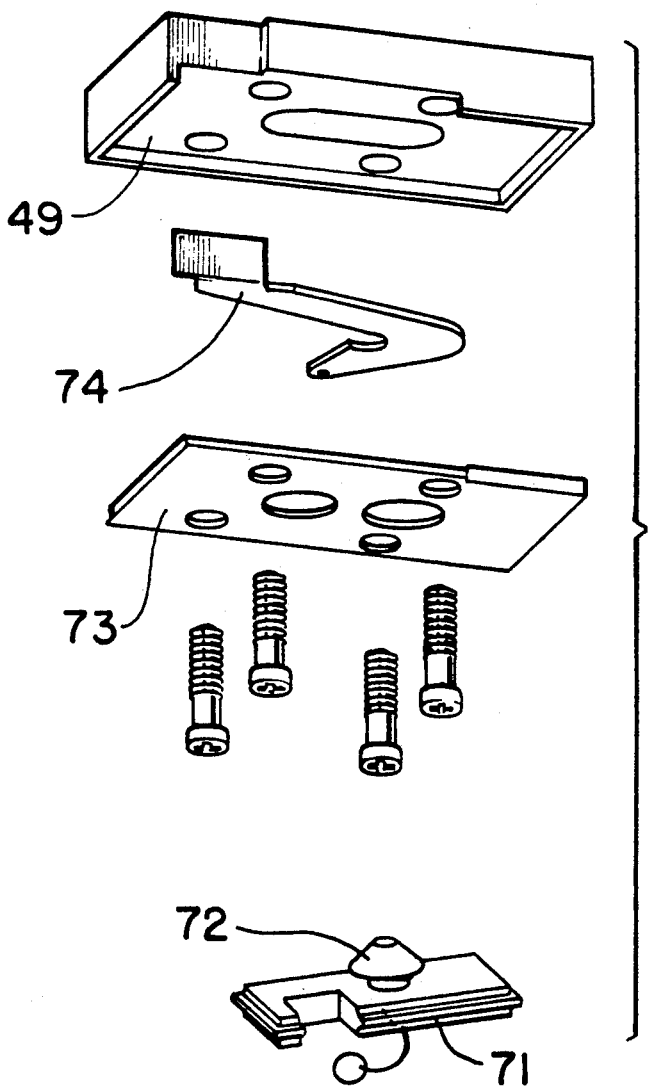
FIG. 3 shows an expanded perspective view of a second form of mounting bracket for the fitting of FIG. 1.

FIG. 3 shows a second form of mounting bracket for the fitting 10 of FIG. 1. The mounting bracket 36 cooperates with a plate 71 comprising a mushroom shaped projection 72. The projection 72 feeds through a retaining plate 73 and engages with a pivoting lock plate 74 on the fixed structure 49.

Figure 4:
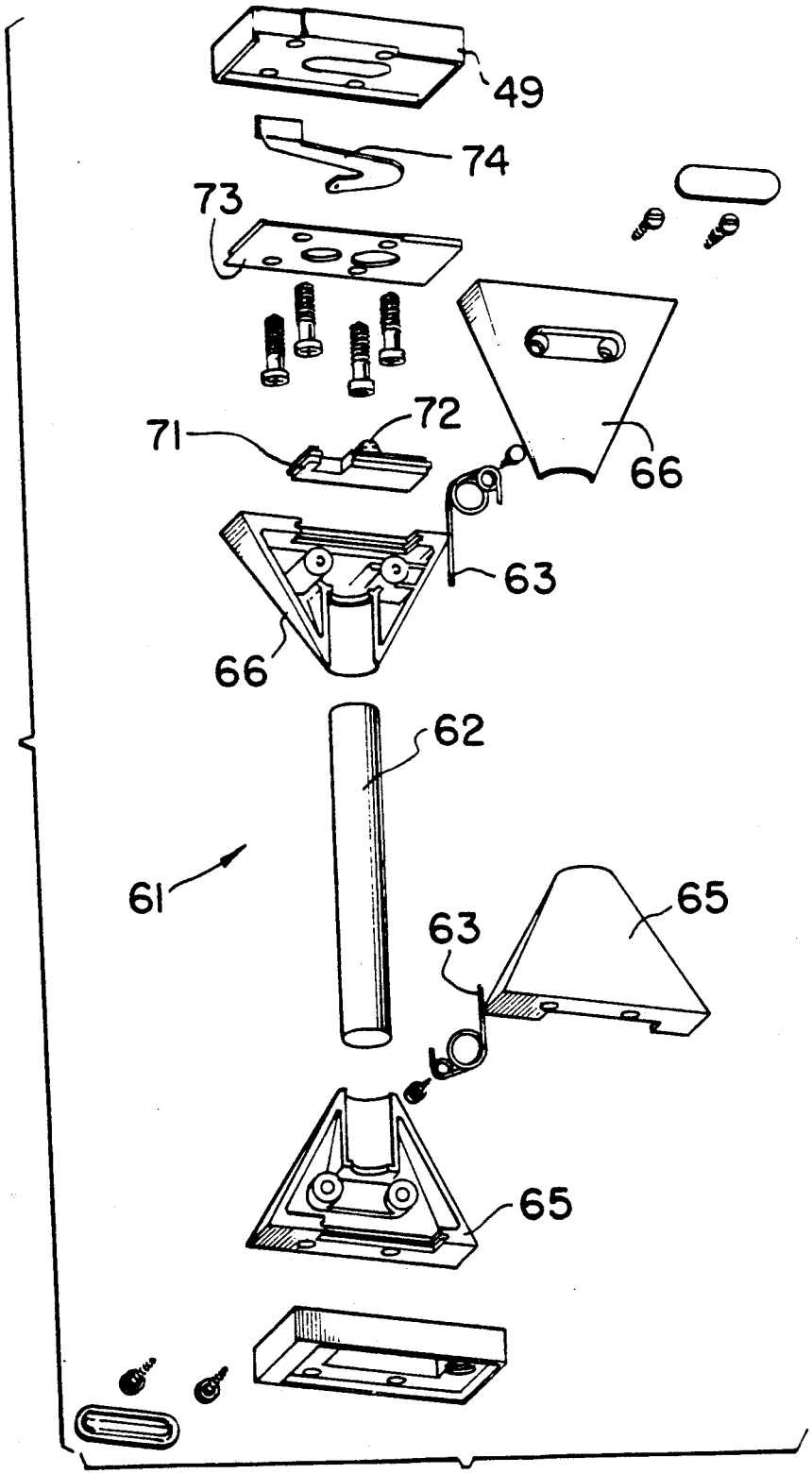
FIG. 4 shows an expanded perspective view of a tubular spacing support for spacing the extrusion of the fitting of FIG. 1 from a fixed structure attached, for example, to a ceiling.

FIG. 4 shows how the fitting of FIG. 1 may be spaced at a distance from the fixed structure 49 by a tubular spacing support, shown generally at 61.

The tubular support 61 comprises a suspension tube 62 and includes a rigidifying tension wire 63 attached to tension wire support screws 64, whereby to rigidify the assembly after the fashion of a magicians "flexible" wand. As shown in FIG. 4, the spacing support 61 also comprises mounting pods 65,66. Mounting pod 66 engages with the Klik plug 47 or plate 71 of FIGS. 2 or 3 respectively, thus enabling the fitting 10 attached to said support 61 to cooperate in quick release fashion with the fixed structure bracket part 49. Clearly the various arrangements can be interchanged thus providing a very flexible approach to installation.

Although the present invention has been described in conjunction with particular embodiments thereof, it will be appreciated by those skilled in the art that various other alterations and additions thereto may be made without departing from its scope as described herein.

When the tubular spacing support arrangement is used, lighting fittings can be suspended at different levels from a ceiling by the provision of tubes of different lengths, which can be used to give a more interesting lighting arrangement than when everything is mounted flush with or depending at a uniform level from the ceiling. The pivotal nature of the mounting arrangement allows fittings to be directed to throw light particularly at work places or on features such as wall decorations, pictures and so on, or just to produce an interesting illumination pattern.

We claim:

1. A space lighting fitting for strip lighting such as fluorescent tubes, said fitting comprising a one-piece extrusion having a wall of substantially constant wall thickness, said wall providing an open, reflector portion which houses lamp holder means for holding a lamp therein and a containment portion which is closed in cross-section by said wall and housing electrical components associated with the electricity supply to the lamp holder means, said containment portion being integrally joined to said reflector portion along two lines between which said containment portion is spaced from said reflector portion and a part of said wall between said lines being common to said reflector portion and said containment portion.

2. A fitting according to claim 1, comprising an aluminum extrusion.

3. A fitting according to claim 1, in which the containment portion comprises a radio frequency screen.

4. A fitting according to claim 1, in which the reflector portion is of elliptical or parabolic cross section.

5. A fitting according to claim 1, in which the containment portion serves as a support for the fitting.

6. A fitting according to claim 5, in which the containment portion houses a pivotal support means for the fitting.

7. A fitting according to claim 6, said pivotal support means comprising an insert which fits snugly inside the containment portion and has journal bearing means for a mounting bracket.

8. A fitting according to claim 7, comprising a two-part mounting bracket which clamps over the journal bearing means whereby the fitting can be adjusted pivotally and retained frictionally in a set angular position.

9. A fitting according to claim 7, in which the mounting bracket cooperates in quick release fashion with a fixed structure bracket part.

10. A fitting according to claim 1, comprising spacing support means for spacing a extrusion from the fixed structure.

11. A fitting according to claim 10, of which said spacing support means comprise tubular support means

12. A fitting according to claim 1, comprising an insert for the reflector portion having a reflective surface.

13. A fitting according to claim 12, said insert being of flexible sheet material whereby to be adapted to the cross section of the reflector portion.

14. A fitting according to claim 12, said insert being of silvered plastics material.

15. A fitting according to claim 1, having end caps closing off the ends of the extrusion and housing the lamp holder means.

16. A fitting according to claim 1, having a lensed refractor closing the reflector portion.

17. A space lighting fitting for strip lighting such as fluorescent tubes comprising an extrusion including an open, reflector portion which houses lamp holder means for holding a lamp therein and a containment portion housing electrical components associated with the electricity supply to the lamp holder means, in which the containment portion serves as a support for the fitting and houses a pivotal support means for the fitting, said pivotal support means comprising an insert which fits snugly inside the containment portion and has journal bearing means for a mounting bracket, in which the mounting bracket houses electrical connector means.

18. A fitting according to claim 17, in which the electrical connector means are fused.

19. A space lighting fitting for strip lighting such as fluorescent tubes comprising an open, reflector portion which houses lamp holder means for holding a lamp therein and a containment portion housing electrical components associated with the electricity supply to the lamp holder means, in which the containment portion serves as a support for the fitting and houses a pivotal support means for the fitting, said pivotal support means comprising an insert which fits snugly inside the containment portion and has journal bearing means for a mounting bracket, in which the mounting bracket cooperates in quick release fashion with a fixed structure in bracket part, and in which the mounting bracket and fixed structure bracket part comprise electrical connection means.

20. A space lighting fitting for strip lighting such as fluorescent tubes comprising an extrusion including an open, reflector portion which houses lamp holder means for holding a lamp therein and an integral containment portion which is closed in cross-section housing electrical components associated with the electricity supply to the lamp holder means, spacing support means for spacing the extrusion from a fixed structure, of which said spacing support means comprise tubular support means, said tubular support means including a rigidifying tension wire.

* * * * *